US007543534B1

(12) United States Patent
Manole et al.

(10) Patent No.: US 7,543,534 B1
(45) Date of Patent: Jun. 9, 2009

(54) LAND MINE, AND HAND THROWN, WEAPON WHICH DISPENSES MARKING CHEMICALS

(75) Inventors: Leon R. Manole, Great Meadows, NJ (US); Stewart Gilman, Budd Lake, NJ (US); Kevin Stoddard, Hackettstown, NJ (US); Ernest Logsdon, Newton, NJ (US); Mark Nicolich, Succasunna, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 530 days.

(21) Appl. No.: 10/906,110

(22) Filed: Feb. 3, 2005

Related U.S. Application Data

(63) Continuation-in-part of application No. 10/708,162, filed on Feb. 12, 2004, now Pat. No. 6,931,993, and a continuation-in-part of application No. 10/707,272, filed on Dec. 2, 2003, now Pat. No. 7,055,438, and a continuation-in-part of application No. 10/605,702, filed on Oct. 21, 2003, now Pat. No. 6,990,905, and a continuation-in-part of application No. 10/605,380, filed on Sep. 26, 2003, now abandoned.

(60) Provisional application No. 60/522,070, filed on Aug. 10, 2004.

(51) Int. Cl.
*F42B 10/00* (2006.01)

(52) U.S. Cl. ..... 102/513; 102/458; 102/498; 102/428; 102/401

(58) Field of Classification Search ..... 102/513, 102/458, 498, 428, 401, 395, 444, 502; 89/1.51
See application file for complete search history.

(56) References Cited

U.S. PATENT DOCUMENTS

| | | | | | |
|---|---|---|---|---|---|
| 3,940,605 | A * | 2/1976 | Gerber | 362/34 |
| 4,690,061 | A * | 9/1987 | Armer et al. | 102/401 |
| 4,706,568 | A * | 11/1987 | Lundwall et al. | 102/513 |
| 5,018,450 | A * | 5/1991 | Smith | 102/513 |
| 5,394,980 | A * | 3/1995 | Tsai | 206/63.5 |
| 5,877,448 | A * | 3/1999 | Denton et al. | 102/401 |
| 5,996,503 | A * | 12/1999 | Woodall et al. | 102/498 |
| 6,145,441 | A * | 11/2000 | Woodall et al. | 102/502 |
| 6,289,819 | B1 * | 9/2001 | Dolderer | 102/513 |
| 6,453,819 | B1 * | 9/2002 | Coates | 102/498 |
| 6,524,286 | B1 * | 2/2003 | Helms et al. | 604/289 |
| 6,615,739 | B2 * | 9/2003 | Gibson et al. | 102/513 |
| 6,619,211 | B1 * | 9/2003 | Haeselich | 102/513 |
| 6,931,993 | B1 * | 8/2005 | Manole et al. | 102/458 |
| 6,990,905 | B1 * | 1/2006 | Manole et al. | 102/513 |
| 7,055,438 | B1 * | 6/2006 | Manole et al. | 102/513 |
| 2001/0045173 | A1 * | 11/2001 | Gibson et al. | 102/513 |

(Continued)

*Primary Examiner*—Michelle (Shelley) Clement
(74) *Attorney, Agent, or Firm*—Michael Sachs

(57) ABSTRACT

Described are flameless tracer munitions that are expelled from land mines or in hand thrown devices, which are used to mark an enemy person, vehicle body, or tires on the vehicle, with materials that emit infrared (IR) light, or heat emitting materials, or with a visible ink or a dye. The subjects are then identified and pursued because of the ink or seen with infrared reading or heat seeking devices. The devices are both long duration (several hours) and also have high light intensity tracing and marking. These munitions are non-impact and non-lethal; are non-toxic, and biodegradable.

3 Claims, 2 Drawing Sheets

U.S. PATENT DOCUMENTS

2002/0134274 A1* 9/2002 Martinez et al. ..... 102/513
2002/0166474 A1* 11/2002 Wygant ..... 102/401
2003/0209163 A1* 11/2003 Huber et al. ..... 102/498
2006/0288898 A1* 12/2006 Byun ..... 102/502

* cited by examiner

LAND MINE, AND HAND THROWN, WEAPON WHICH DISPENSES MARKING CHEMICALS

CROSS REFERENCE TO RELATED APPLICATIONS

This application claims benefit under 35 USC 119(e) of provisional application 60/522,070 filed Aug. 10, 2004 the entire file wrapper contents of which are incorporated by reference herein as though fully set forth. This application is a continuation in part of application Ser. No. 10/605,702 filed Oct. 21, 2003 claiming benefit of provisional application 60/481,041 filed Jun. 30, 2003; and of Ser. No. 10/605,380 filed Sep. 26, 2003 claiming benefit of provisional 60/320,042 filed Mar. 24, 2003; also of application Ser. No. 10/707,272 filed Dec. 2, 2003 claiming benefit of provisional application 60/481,529 filed Oct. 21, 2003; and also of application Ser. No. 10/708,162 filed Feb. 12, 2004, the entire file wrapper contents of all which applications are incorporated by reference herein as though fully set forth.

FEDERAL RESEARCH STATEMENT

The invention described herein may be made, used, or licensed by or for the United States Government for U.S. Government purposes.

BACKGROUND AND FIELD OF THE INVENTION

This invention relates generally to the field of flameless tracer munitions and in particular it pertains to application by land mines or by hand thrown devices of non-lethal, flameless tracer/marker materials capable of tracing or marking subjects in a non-lethal manner.

Currently there are strategic areas that need to be protected from ingress and egress of enemy or non authorized personnel and/or vehicles. These strategic areas are protected by both lethal and non-lethal mines. These strategic areas can be land or ground that separates countries, or land that surrounds soldiers, land that should not be accessed by enemy or non-authorized personnel or vehicles. The strategic areas and limited access sites can also be buildings, rooms or corridors within a building or areas surrounding a strategic building. Some examples could be nuclear power plants, headquarters for the military, commercial rooms or buildings with company secret documents, for instance. Currently lethal mines are used by the military to protect assets and military lives. Non-lethal mines or devices are used by private or commercial industry, and the military to guard assets and personnel without harm to the intruder or a vehicle. The non-lethal mines function by shooting out rubber or plastic balls, ink or dye, which deter and may mark the person or vehicle that entered a location. The ink marks the person or vehicle therefore allowing the military or law enforcement to recognize the person or vehicle and apprehend same. A problem is that the person can see the ink and remove the clothing, or clean the vehicle in order not to be apprehended. In addition, ink can not be easily spotted at a distance or at night.

Presently, the military has need for devices to illuminate an area such as a cave or hole with a non-flammable light source that is biodegradable, hand held and non-lethal and that can also mark personnel and vehicles with a light source that lasts for several minutes to several hours. Soldiers presently throw chemlucent light sticks into a cave or hole but they only light up the area that they were thrown into and do not mark the people. If a light stick is broken and the liquid poured out, it only lasts for a few minutes before the light goes out.

There exists a need for commercial and military mines to expell a chemlucent powder or liquid that can mark the person or a vehicle with a visible or IR light, that is non-flammable, non-toxic and bio-degradable, and also glow for minutes or up to several hours.

There is also the need for a non-lethal hand held device that can be thrown into a cave or hole and dispense or expell a chemlucent powder or liquid that can light up and mark a person or vehicle with a visible or IR light that is non-flammable, non-toxic and biodegradable, and will glow for minutes or up to several hours.

In both cases, the objective is to mark persons and their clothes, or a vehicle, entering an area. In addition, the chemlucent that gets onto the ground will get onto the tires of a vehicle or onto the shoes of a person. Since the chemlucents can be made to emit visible or infrared (IR) light, the object marked will glow for hours in either visible or IR light. The IR light can only be seen by people using Night Vision Devices (NVD) or similar devices. The person or vehicle marked in visible light can be apprehended quickly and easily picked out of a crowd. The person marked in IR will not know it and can be followed if needed or quickly apprehended. The chemlucent will adhere to a person, clothing or vehicle and is non toxic, non-flammable, biodegradable and gives off very little heat. It would be excellent for marking as delivered from a mine set to mark unwanted or unauthorized people or vehicles when they come into an area. The person or vehicle marked will glow and can be seen from great distances in low light conditions. Therefore, they can be easily followed by foot or by helicopter.

U.S. Pat. No. 6,497,181 entitled "Flameless Tracer Ammunition" which is incorporated herein by reference as though fully set forth, discloses a flameless tracer and marker for small munitions and canon caliber projectiles that include non-toxic, environmentally friendly chemiluminescent materials which are maintained in separate compartments within the munition(s). When fired, the chemiluminescent materials mix, thereby glowing intensely for several minutes and may be therefore be used to trace the path of the fired munition(s), or mark a target area upon impact.

The materials were obtained by mixing an oxalate ester in powdered form with a liquid peroxide to form a light emitting slurry. The materials so obtained exhibit both long duration and high light intensity tracing and marking characteristics not available earlier. Of particular advantage, the oxalate component employed was in powdered form which when mixed with liquid peroxide, produced a non-toxic slurry that was found to be both non-flammable and biodegradable. Such tracer ammunition might in certain cases be intolerant of the high impact and/or lethality characteristics of high-speed projectiles. Accordingly, non-lethal, non-impact flameless tracer munitions of this invention, and those that may be deployed by-hand, represent a significant advance in the art.

SUMMARY OF THE INVENTION

We have developed flameless tracer/marking munitions that can be delivered by land mines or also thrown by hand. These also provide long duration and high light intensity tracing and marking, do not require high impact for operation, and additionally are not lethal, non-toxic and biodegradable.

Other objects, features and advantages of the present invention will become more apparent in light of the following detailed description of a preferred embodiment thereof.

BRIEF DESCRIPTION OF THE DRAWINGS

Various features and advantages of the present invention and the manner of attaining them will be described in greater detail with reference to the following description, claims and drawings in which:

DETAILED DESCRIPTION

Figure 1:
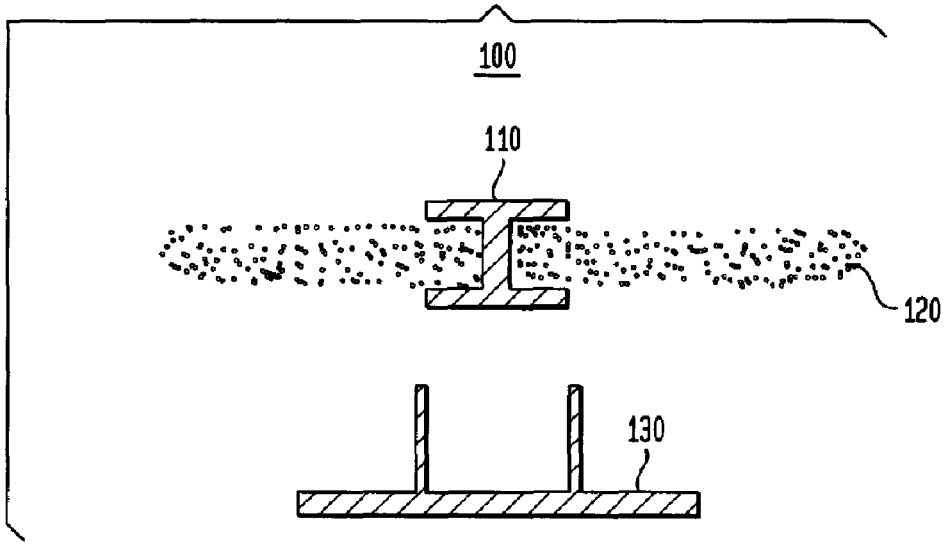
FIG. 1 (PRIOR ART)
FIG. 1 illustrates in cross section a prior art M16A2 personnel marker dispensing rubber or plastic balls.

FIG. 1 is a cross sectional view of the M16A2 non-lethal mine 100. When activated, a dispenser 110 is released from the mine housing 130. The dispenser 110 is spun up and jumps out of the housing 130 releasing the inside cargo of the mine, such as plastic balls or rubber balls, ink or dye (120). The spinning action disperses rubber or plastic balls or permanent fluid such as ink or dye (120) in a 360 degree direction. Similarly other non-lethal mines release their cargo of rubber or plastic balls or permanent fluid such as ink or dye (120) by gas pressure (not shown).

The M16A2 land mine referenced is a steel bodied bounding mine that is generally cylindrical in shape and resembles a large tin can in appearance. A fuse, in response to tripwire pull or applied pressure, activates the mine.

When activated, dispenser 110 bounds up and out of mine housing 130 as much as 1.5 meters into the air, while spinning on its axis at an extremely high rate of revolutions per second. Mine cargo 120 is subsequently dispersed throughout a nearly 360-degree area through the action of spinning dispenser 110 and/or a delayed explosive charge.

Figure 2:
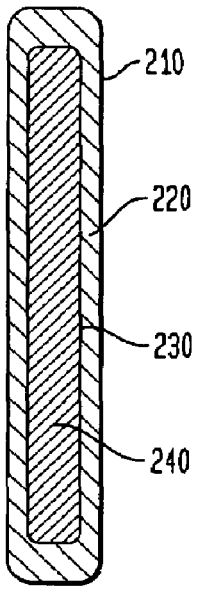
FIG. 2 (PRIOR ART)
FIG. 2 illustrates in cross section, a prior art chemical light stick.

FIG. 2 is a cross sectional view of a chemlucent light stick 200 common to industry. The light stick 200 contains a polypropylene or polyethylene plastic transparent container 210. A glass vial 230 is inside the transparent container 210. A chemlucent liquid 220 is outside the glass vial 230 and a chemlucent liquid 240 is inside the glass vial 230. The light stick 200 is activated by bending the light stick 200 and breaking the glass vial 230. The chemlucent chemicals 220 and 240 mix together and give off visible or IR light.

Chemlucents (reference is again made to U.S. Pat. No. 6,497,181) are currently used to provide a non-flammable, non-toxic, biodegradable trace/mark for a single projectile. In order to accomplish this, the chemlucents are contained within the projectile and cause the projectile to glow after setback (therefore proving trace) and mark the target by scattering on the target after the projectile breaks upon impact with the target and leaving the glowing chemlucent chemicals on the target. The chemlucent chemicals are also used as trace/mark for non-lethal projectiles and work similar to the concept above, except the projectile is made of non-lethal soft materials. As taught in U.S. Pat. No. 6,497,181 the chemlucents can be made in a liquid form and will produce visible and IR light for a few minutes and can be made in a powdered form and produce light in the visible and IR regions for from several minutes to several hours. These chemlucent chemicals can be used in a non-lethal mine as described herein.

The chemical reaction in a light stick such as 200 contains several chemiluminescent chemicals including a hydrogen peroxide solution, a solution containing a phenyl oxalate ester and a fluorescent dye. When the phenyl oxalate ester contacts the hydrogen peroxide, it is oxidized into a phenol and a peroxyacid ester. The peroxyacid ester decomposes, producing an intermediate which further decomposes and transfers energy to the fluorescent dye. This energy transfer results in the dye releasing energy in the form of light. As one can readily appreciate, a light stick such as 200 is just a container for mixing the solutions involved in the reaction.

Typically, the phenyl oxalate ester and dye solution fills the volume of the body 210 and the hydrogen peroxide solution, called an activator, is contained in the sealed vial 230—also located in the volume of the body 210. Bending the stick body 210 breaks the sealed vial 230 and the solutions flow together. The particular fluorescent dye used gives the light a distinctive color.

Depending upon which materials are used in the solutions, the chemical reaction may continue for a few minutes or a few hours. In addition, the overall duration of the reaction is temperature dependent. For example, if the reaction is at an elevated temperature, the extra energy will accelerate the reaction and the stick will glow brighter, but for a shorter amount of time. Similarly, if the reaction is performed at a lower temperature, the reaction will slow down and the light will dim.

Figure 3:
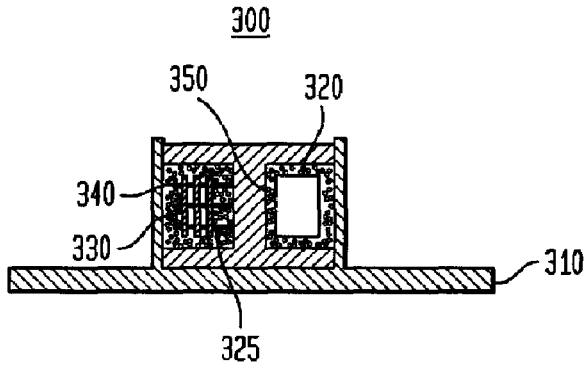
FIG. 3 illustrates in cross section, a modified M16A2 personnel marker dispensing chemiluminescent materials according to the present invention.

FIG. 3 shows a cross sectional view of a mine (300) loaded with chemlucent chemicals ready to be employed. The standard M16 mine was chosen to show the utility of the chemlucents, however any non-lethal mine that disperses items can be used. The base of the mine (made of metal, plastic or composite) is shown at 310. An inner core dispenser 320 (made of metal, plastic or composite) has been modified to contain mixing blades 325 made of polyproplene or polyethylene. Powdered chemlucent chemical 1 (see 330) is placed inside dispenser 320. Liquid chemlucent chemical 2 can be placed inside of glass vials 340 and held by a plastic (polypropylene or polyethylene) spider (not shown) and placed inside the dispenser (320). Alternately, liquid or powder chemlucent chemical 1 can be placed inside of glass vials and put inside the dispenser 320. In another embodiment, chemlucent chemical 1 and chemlucent chemical 2 can be placed inside separate plastic bags 350 and placed inside the dispenser.

When the mine is activated, the dispenser spins breaking the vials and/or bags and mixes the chemicals. They will then begin to glow in visible or IR light depending on the chemicals used.

Figure 4:
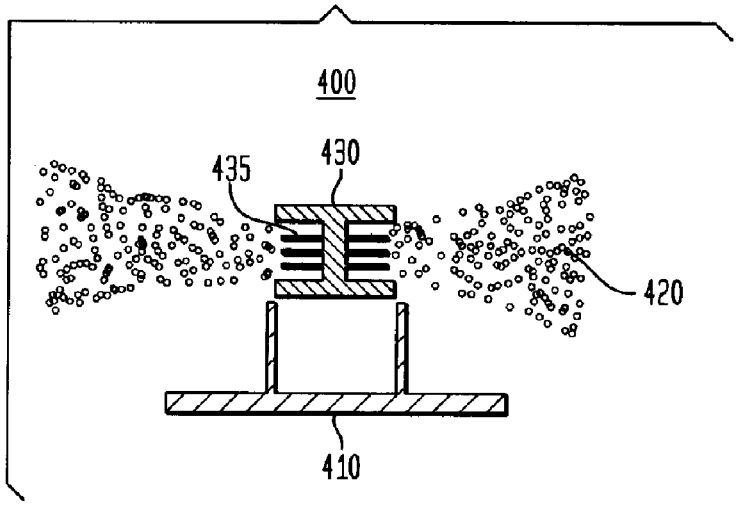
FIG. 4 illustrates in cross section, an alternative embodiment of a modified M16A2 personnel marker dispensing chemiluminescent materials according to the present invention.

FIG. 4 is a cross sectional view of the mine as it dispenses the glowing chemlucent chemicals. The mine 400 has been activated and the dispenser 430 spins and jumps up from base 410 in the normal manner that the M16 mine components do. As the dispenser 430 spins and jumps out of the base 410 the chemlucent chemicals 420 are mixed and glowing and dispersed in a 360 degree manner away from the mine as shown. The chemicals 420 adhere to the person or vehicle to be marked and adhere to the shoes or tires of a vehicle. The chemlucent chemicals will adhere even in rain. The person or vehicle will now be marked in either visible or IR light for several hours. The marking is non-toxic, non-flammable and biodegradable. The person or vehicle can be easily apprehended or followed by helicopter.

A handheld device (not shown) similar to the mine can be made by shrinking the mine device down to a size that is handheld. A CO2 cylinder is placed below the dispenser and connected to a switch on the outside of base. The switch is connected to the CO2 cylinder by a rod. When the switch is pressed the rod breaks the top of the cylinder releasing CO2 gas. The gas spins the dispenser and it leaves the base. Chemlucent chemicals are therefore dispersed. This device can be used by hand and thrown into caves, holes, or where ever needed.

It will be apparent to those skilled in the art that the mine 400, or other similar device may be triggered by a variety of devices such as trip wires, pressure switches, magnetic switches and/or proximity sensors.

Figure 5:
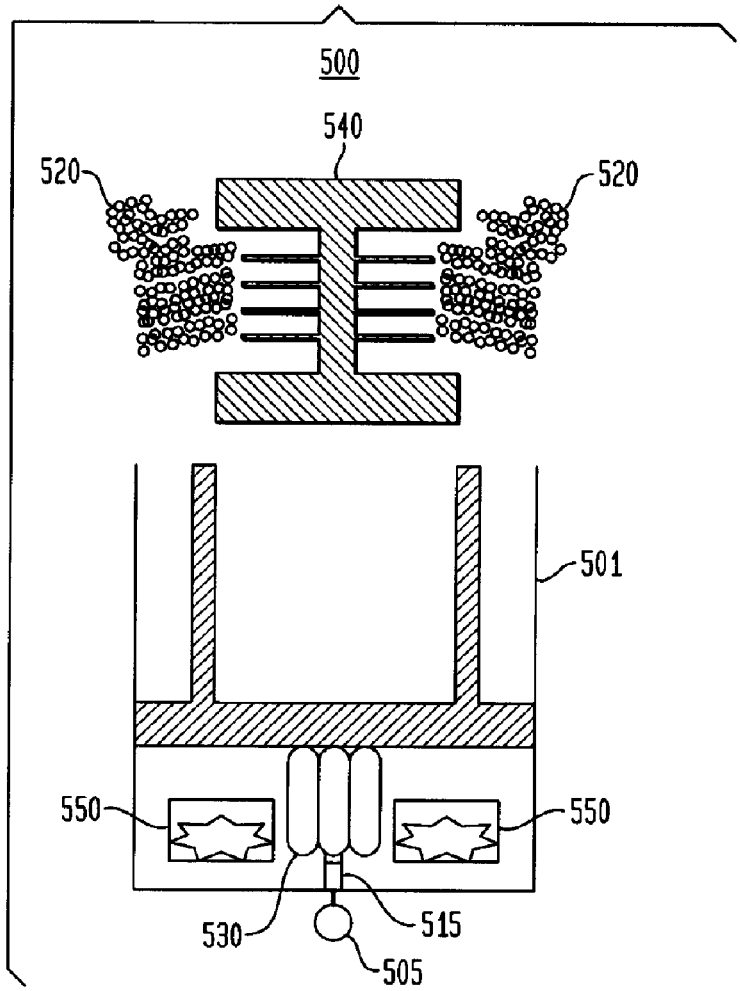
FIG. 5 illustrates in cross section, an additional alternative embodiment of a hand-held personnel marker dispensing chemiluminescent materials according to the present invention.

Still further, and with reference now to FIG. 5, there is shown in cross section a handheld device 500 that provides the non-lethal marking taught by the present invention. In particular a handheld device comprises a body 501, which is sized such that it may be carried and/or thrown by hand. Carrier 540 holds chemiluminescent chemical 520, which may be held in separate portions of the carrier 540. When the device 500 is made active by, for example, pulling pin 505, compressed gas (e.g., CO2) contained within dispersion gas cylinders 530 is released causing dispenser 540 to spin up thereby dispersing the chemiluminescent chemicals 520 throughout a local area.

Advantageously, the dispersion gas need not be contained within a cylinder such as 530; rather it may be generated by, for example chemical reactions. In such an embodiment, when the pin 505 is withdrawn, gas generators 550 may generate gas explosively and thereby cause dispenser 540 to spin up and disperse the chemiluminescent chemicals 520. As can be appreciated, gas generators 550 may contain reaction chamber for mixing sodium azide with potassium nitrate to produce nitrogen gas somewhat explosively. This system, coupled with small accelerometers (not specifically shown) would produce a device, which required a pre-determined acceleration/deceleration to cause the sodium azide/potassium nitrate chemical to mix. Consequently, a device that discharged after being thrown would be possible.

Of course, it will be understood by those skilled in the art that the foregoing is merely illustrative of the principles of this invention, and that various modifications can be made by those skilled in the art without departing from the scope and spirit of the invention. In particular, different shapes, sizes and chemiluminescent materials are envisioned. Additionally, alternative dispersion systems, i.e., gases, explosive charges etc., in addition to those already known and well understood, will likely be employed. Accordingly, our invention is to be limited only by the scope of the claims attached hereto.

What is claimed is:

1. A flameless mine for marking a target comprising:

a base;

a spinnable inner core dispenser positioned within the base, said dispenser having a plurality of mixing blades affixed thereto;

chemiluminescent reagents including an oxalate ester component and a peroxide component, said components being located within the spinnable inner core dispenser such that they are chemically isolated from one another; and an activator for initiating the spinning of the inner core dispenser and its ejection from the base;

such that upon activation the inner core dispenser spins such that the mixing blades effect the mixing of the chemiluminescent components which are subsequently dispersed as a result of the spinning of the dispenser and its ejection from the base;

wherein the chemiluminescent materials are sufficiently mixed by the action of the mixing blades to glow chemiluminescently prior to their dispersal such that they are chemiluminescent before striking an object as a result of their dispersal.

2. The mine according to claim 1 wherein the oxalate component is a powder form.

3. The mine according to claim 2 wherein the peroxide component comprises liquid hydrogen peroxide.

* * * * *